United States Patent [19]

Branscum

[11] Patent Number: 4,523,699

[45] Date of Patent: Jun. 18, 1985

[54] COMBINATION ICE SCREEN AND AIR VENT FOR LIQUID CONTAINER

[75] Inventor: Tony E. Branscum, Cowley County, Kans.

[73] Assignee: Gott Corporation, Winfield, Kans.

[21] Appl. No.: 489,809

[22] Filed: Apr. 29, 1983

[51] Int. Cl.[3] ..... B67D 3/00

[52] U.S. Cl. ..... 222/189; 222/479; 222/567

[58] Field of Search ..... 222/189, 464, 478, 479, 222/481, 481.5, 563, 564, 566, 567, 569; 220/366, 367, 90.2, 90.4, 90.6

[56] References Cited

U.S. PATENT DOCUMENTS

| | | | |
|---|---|---|---|
| 1,284,716 | 11/1918 | Larios et al. | 222/479 |
| 2,210,676 | 8/1940 | Krannak | 222/189 |
| 2,258,524 | 10/1941 | Vigurs | 222/189 |
| 2,649,967 | 8/1953 | Tyson | 222/189 |
| 3,000,544 | 9/1961 | Roberts | 222/479 |
| 3,098,586 | 7/1963 | Wasserberg | 222/478 |
| 3,506,167 | 4/1970 | Orr | 222/479 |
| 4,273,265 | 6/1981 | Anderson | 222/189 |

FOREIGN PATENT DOCUMENTS

| | | | |
|---|---|---|---|
| 539220 | 7/1955 | Belgium | 222/479 |

*Primary Examiner*—H. Grant Skaggs

*Attorney, Agent, or Firm*—Kokjer, Kircher, Bradley, Wharton, Bowman & Johnson

[57] ABSTRACT

This invention is directed to a combination air vent and ice screen for liquid containers. The invention comprises an insert which fits into a liquid beverage container through the opening of the lid and is positioned on the inside of the lid. The insert prevents ice cubes from blocking the flow of liquid by means of a screen at the bottom of the insert. The insert also introduces air into the container by means of a channel which extends along the container opening and laterally along the side of the container lid. When pouring liquid from the container, only liquid passes through the screen while at the same time air is allowed to enter the container through the aforedescribed opening.

1 Claim, 6 Drawing Figures

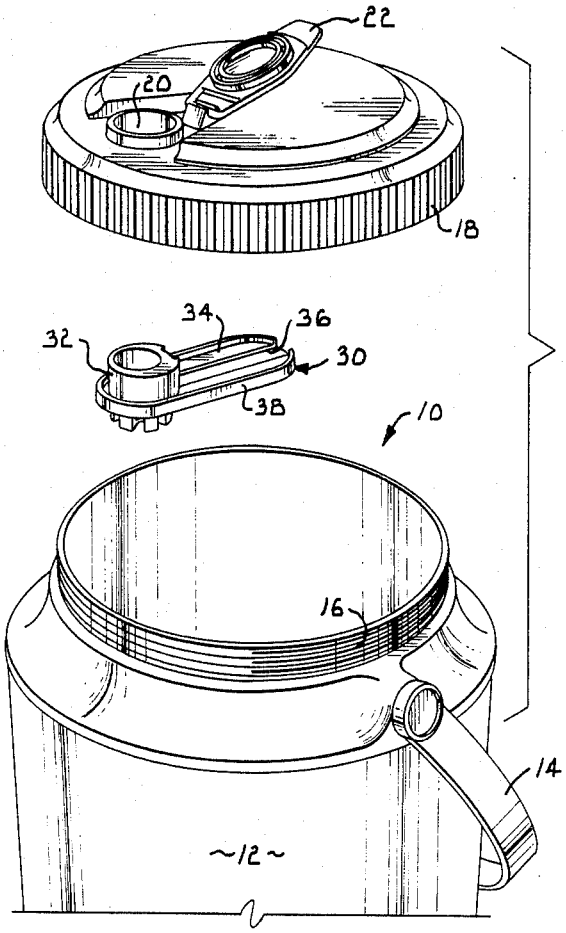
Fig. 1.
Fig. 2.
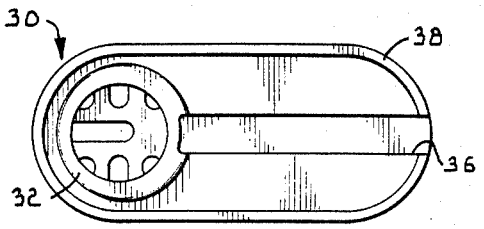
Fig. 3.
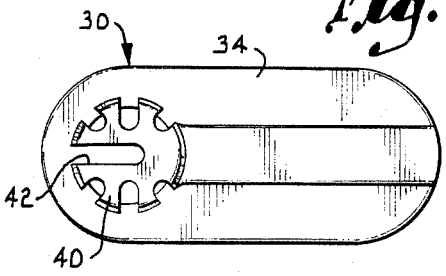
Fig. 4.
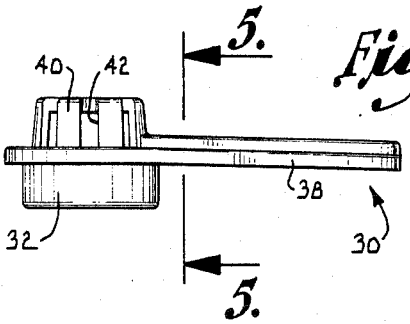
Fig. 5.
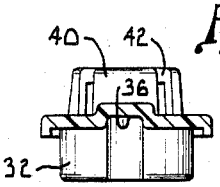
Fig. 6.
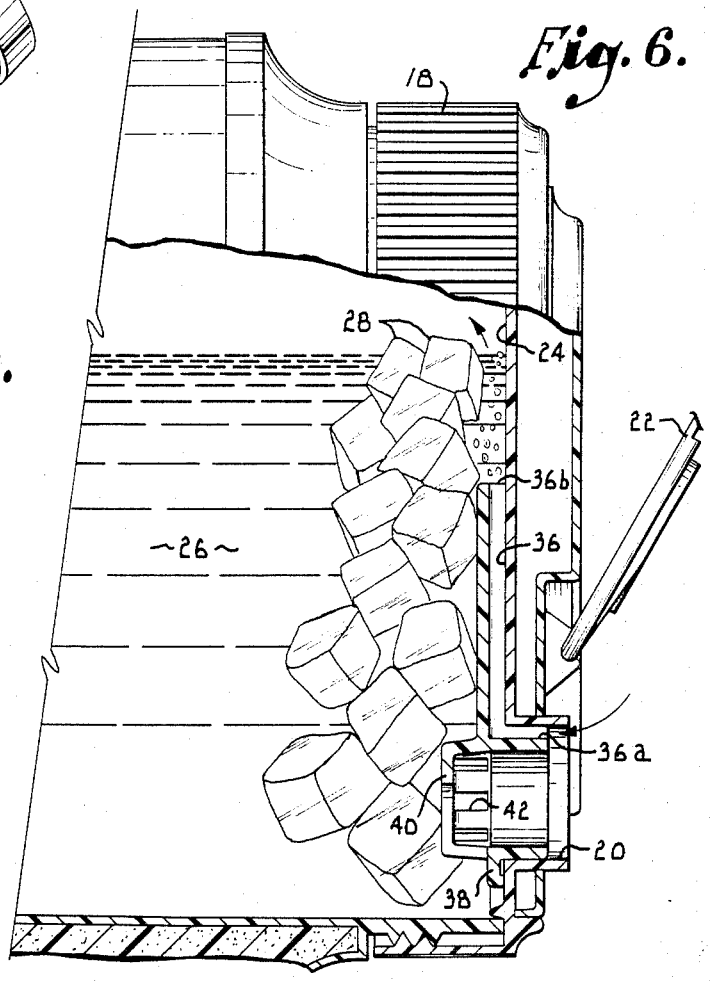

COMBINATION ICE SCREEN AND AIR VENT FOR LIQUID CONTAINER

This invention relates generally to liquid containers and, more particularly, to a combination air vent and ice screen for liquid containers.

Numerous types of containers are available for transporting a wide variety of liquids. Frequently such containers have an opening in their lid, or at another location near the top of the container to permit pouring of the liquid therefrom. Pouring from a closed container is made difficult by the partial vacuum which occurs inside the container when some liquid is removed. The resulting pressure differential between the inside and the outside of the container restricts the flow of liquid through the opening. This pressure differential may be relieved by partially unscrewing the lid, if the lid is so constructed, although this extra step is often forgotten, may result in linkage through the lid, and at best is time consuming and cumbersome.

Another problem with containers utilized for carrying liquid beverages is that when ice is utilized to cool the beverage some ice may be lost through the container opening during pouring.

It is therefore a primary object of the present invention to provide means for relieving the pressure differential between the inside and the outside of a liquid container during pouring so as to facilitate the pouring operation.

Another objective of my invention is to provide an ice screen which will prevent ice from being lost while liquid is being poured.

It is also a primary aim of the invention to provide an ice screen for a liquid container which will provide adequate "open space" in the screen for passage of liquid that, even when the screen is partially blocked by ice, a smooth liquid flow is possible.

Another objective of the invention is to provide a combination pressure relief device and ice screen as set forth in the preceding two objects.

Another aim of the invention is to provide a combination ice screen and pressure relief device which can be inserted into the pour openings of existing containers without requiring major redesign of the container itself.

It is a further objective of the invention to provide a combination pressure relief device and ice screen as set forth in the proceding aims and objects which can be molded from plastic and produced economically.

Other objects and advantages of the invention will be made clear and will become apparent from the following description and claims when read in light of the accompanying drawing wherein:

FIG. 1 is an exploded view of a liquid container and lid therefore incorporating the combination air vent and ice screen of the present invention;

FIG. 2 is a top plan view of the device of the invention;

FIG. 3 is a bottom plan view of the device shown in FIG. 2;

FIG. 4 is a side elevational view of the combination air vent and ice screen of the present invention;

FIG. 5 is a vertical cross-sectional view taken along line 5—5 of FIG. 4; and

FIG. 6 is an enlarged fragmentary side elevational view of a container utilizing the device of the invention with portions broken away and shown in cross section for purposes of illustration.

Referring initially to FIG. 1 a liquid container according to the present invention is designated generally by the numeral 10 and includes an open topped vessel 12 having an integral pivotable handle 14 and a threaded upper lip 16.

The top portion of container 10 is presented by a lid 18 which is complementally threaded for engagement with thread 16. Lid 18 presents a generally round opening 20 through which liquid may be poured from the closed container. Opening 20 is closed by a snap fit flap 22. As illustrated in FIG. 6, lid 18 has a flat inner surface 24 in the area immediately adjacent opening 20. Further referring to FIG. 6 a liquid beverage is designated by the numeral 26 and is being cooled by ice cubes 28.

The device of the present invention is designated generally by the numeral 30 and comprises a tubular insert 32 the outside wall of which is adapted to frictionally engage the wall presenting opening 20. Extending at an angle of less than 90° relative to insert 32 is a generally planar lateral extension 34 which extends for a distance at least approximately twice the diameter of opening 20. It is to be noted that the thickness of the insert wall increases on the side adjacent lateral extension 34. Formed in this thickened wall and extending along extension 34 is a continuous through channel 36 defining an air passage extending along the side of container opening 20 and along the inside surface 24 of the lid. Channel 36 has an inlet **36*a* and an outlet 36*b***.

A collar 38 projects from extension 34 and extends around the perimeter of the latter and also around insert 32. The fact that extension 34 forms an angle of slightly less than 90° causes a bias favoring retention of insert 32 within opening 20 when the extension is pressed against flat surface 24.

Integral with insert 32 and extension 34 is a screen member 40 which projects in the opposite direction from the direction of extension from insert 32. Screen member 40 is characterized by a plurality of open areas 42 through which liquid may pass. By having member 40 extend away from insert 32 the total area represented by openings 42 may be substantially increased over that which would be presented by a flat screen extending across the opening presented by insert 32.

The device 30 is preferably made of moldable material such as plastic and sized so that the insert 32 will present a tight frictional engagement with the wall of opening 20. When liquid is poured from the container, as illustrated in FIG. 6, air enters the passageway presented by channel 36 thus relieving the partial vacuum within the container caused by liquid being withdrawn. The ability of air to enter the container through channel 36 is dependent upon there being an adequate pressure differential between the channel opening **36*a* and the container opening. That is, air attempting to enter opening 20 will be resisted by a water pressure which is proportional to the depth (X) of the water acting on the opening. Air attempting to enter channel 36 will be resisted by a water pressure which is proportional to the depth (Y) of the water above the channel outlet 36(*b*). As long as the length of extension 34 is sufficient so that X minus Y equals a value which allows for flow of air through the channel (even when the container is substantially full of liquid), functioning of the device will not be hampered by water covering outlet 36(*b*). It has been found that a length for extension 34 of approximately twice the diameter of opening 20, when the latter is ¾ inch, will allow an adequate flow of air to accommodate a free flow of liquid. Screen 40 precludes ice cubes 28 from passing through opening 20. Preferably, the total area presented by openings 42 in member 40 will exceed the area opening 20 so that, even if some of the openings are blocked by ice, there will still be a free flow of liquid through opening 20**.

While the invention has been particularly described with reference to a container having a screw lid, it will be appreciated that the invention may also be utilizied with other types of containers where the pour opening is formed in the vessel portion instead of the lid itself.

I claim:

1. A combination air vent and ice screen device for application to a liquid container having a top portion presenting a flat inner surface, an opening through which liquid may be poured from the container, and a spout wall extending around the opening and projecting outwardly from the top portion of the container, said device comprising:

a tubular insert having a size to fit closely within the spout wall in engagement therewith in a manner to be frictionally retained within the spout wall in registration with the opening, said insert having open opposite ends;

a planar extension rigid with said insert and projecting laterally to one side thereof, said extension having a collar projecting from the perimeter thereof and contacting the flat inner surface of the top portion of the container;

a thickened wall portion of said tubular insert on one side thereof having a greater thickness than the remainder of the insert;

an air channel formed partially in said thickened wall portion of the insert and partially in said extension to provide a vent passage extending from the outside of the container to the inside of the container, said channel having a terminal end extending through said collar and said channel permitting air to pass therethrough into the container when liquid is poured from the container through said tubular insert; and a generally cup shaped ice screen rigid with said insert and projecting therefrom into the container to prevent ice in the container from blocking the flow of liquid into the insert, said ice screen having a side wall and an end wall both exposed to the interior of the container and both presenting a plurality of openings through which liquid may pass.

* * * * *